US006419275B1

(12) United States Patent
Huault

(10) Patent No.: US 6,419,275 B1
(45) Date of Patent: Jul. 16, 2002

(54) INSTRUCTION LEAFLET MADE OF PAPER COMPRISING A BOX WHICH CONTAINS THIS INSTRUCTION LEAFLET TOGETHER WITH THE SAID PACKAGING AND A CONTENT, A METHOD OF MAKING THE SAID INSTRUCTION LEAFLET

(75) Inventor: Stéphane Huault, Soyaux (FR)

(73) Assignee: Rotanotice, Soyaux (FR)

( * ) Notice: Subject to any disclaimer, the term of this patent is extended or adjusted under 35 U.S.C. 154(b) by 0 days.

(21) Appl. No.: 09/433,180

(22) Filed: Nov. 3, 1999

(30) Foreign Application Priority Data

Nov. 3, 1998 (FR) ..... 98 13808

(51) Int. Cl.[7] ..... B42D 15/00

(52) U.S. Cl. ..... 283/61; 283/62; 283/56; 281/2; 281/3.1; 281/5

(58) Field of Search ..... 283/61, 62, 56, 283/117, 63.1; 286/2, 5, 10, 38, 15.1, 21.1

(56) References Cited

U.S. PATENT DOCUMENTS 4,188,880 A * 2/1980 Figov et al. ..... 283/61 X
5,826,914 A * 10/1998 Hudetz ..... 283/61
5,857,705 A * 1/1999 Dahlquist ..... 283/61 X

FOREIGN PATENT DOCUMENTS

| | | | |
|---|---|---|---|
| CH | 190740 | 7/1937 | |
| CH | 588949 | 6/1977 | ..... B42D/5/00 |
| EP | 274872 | 7/1988 | ..... B65H/37/02 |
| EP | 723876 A2 | 7/1996 | ..... B42D/5/00 |

* cited by examiner

*Primary Examiner*—Willmon Fridie, Jr.
(74) *Attorney, Agent, or Firm*—Nawrocki, Rooney & Sivertson, P.A.

(57) ABSTRACT

An instruction leaflet made of paper comprising a box which contains this instruction leaflet together with the packaging and a content is provided along with a method of making same. The invention relates to an instruction leaflet for pharmaceutical products or similar comprising at least two superposed sheets joined on one of their edges, the instruction leaflet comprising at least one thinning line allowing the division of the originally single instruction leaflet into at least two distinct parts.

25 Claims, 9 Drawing Sheets

INSTRUCTION LEAFLET MADE OF PAPER COMPRISING A BOX WHICH CONTAINS THIS INSTRUCTION LEAFLET TOGETHER WITH THE SAID PACKAGING AND A CONTENT, A METHOD OF MAKING THE SAID INSTRUCTION LEAFLET

TECHNICAL FIELD

The invention relates to instruction leaflets made of paper for receiving printed information, especially intended to be included in packaging such as boxes for pharmaceutical products. The invention more particularly relates to such an instruction leaflet and its method of making.

BACKGROUND OF THE INVENTION

An instruction leaflet made of paper or similar material, made flat, is already known which comprises at least two superimposed thin sheets on which the information is printed, rigidly joined together in an area of association along and close to a common straight side of their edge, the instruction leaflet being possibly folded, notably parallel and/or perpendicular to the direction of the area of interdependence, and especially intended to be included in a packaging such as box for a pharmaceutical product or similar. An embodiment of such an instruction leaflet is also known. Documents EP-A-274 872, EP-A-673 870 related to such instruction leaflets for pharmaceutical products. The subject invention intends to improve previously known instruction leaflets.

SUMMARY OF THE INVENTION

The subject invention relates to an instruction leaflet of the previously mentioned type which, on at least one of its sheets, comprises a thinning, extending longitudinally, so as to allow manual tearing at this place, the thinning crossing the edge of the corresponding sheets at both extremities and allowing the separation of the originally single instruction leaflet into at least two distinct parts.

According to other characteristics, the thinning has the form of a succession of spaced perforations, with or without removal of material, or a continuous or discontinuous localized thinning.

According to one possibility, at least at one of these two extremities, the thinning is fitted with a tearing leader such as a V-shaped notch. As the case may be, the rupture leader is located at both thinning extremities.

According to a first embodiment, the thinning is located at least partly besides, along and close to the area of interdependence. More particularly, the thinning is totally located besides, along and close to the area of interdependence.

According to a second embodiment, the thinning is at least partly located along and within the area of interdependence.

According to another aspect, and to the first embodiment, only one sheet is fitted with a thinning.

According to this aspect, and to the second embodiment, several sheets are fitted with a thinning. Particularly, all the sheets are fitted with a thinning. When several sheets are fitted with a thinning, the thinning of the various sheets are superimposed on the whole.

According to another aspect, one or several sheets are fitted with a thinning, while one or several of the other sheets comprise a modification resulting from the realisation of the thinning perpendicular to the thinning. However, this modification is normally not intended to the manual tearing of separation like the thinning.

According to another aspect, the thinning extends longitudinally along a straight line. This straight line comprises a unique segment, or several segments, forming angles.

According to another aspect, the general shape of the thinning is a single thinning line or several juxtaposed lines or a thinning area or several juxtaposed areas.

According to a particular embodiment, the thinning crosses, at least at one of both extremities, at least one of the sides close to the one along which the area of interdependence extends. In particular, at both extremities the thinning crosses both sides adjoining the one along which the area of interdependence extends.

According to another aspect, and to the embodiments, the thinning does not cross the area of interdependence or cross it in contrary.

According to another characteristic, and to a particular embodiment, the thinning is located so that at least one of the distinct parts resulting from the tearing at the thinning place substantially corresponds to one of the sheets, except essentially the area of interdependence, which belongs to the other part.

An instruction leaflet such as the one described is typically rectangular or square. The sheets, at least some of them, have sensibly the same shape and dimensions. The paper sheet thickness can reach the thickness of bible paper. An instruction leaflet such as the described one can be presented not flat but folded parallel and/or perpendicular to the direction of the area of interdependence and on the side adjoining the edge.

According to another aspect, the invention also concerns a packaging comprising a principal box or the like, and, inside, an instruction leaflet such as previously described.

According to another aspect, the invention also concerns a set comprising packaging as mentioned above and contents located in the main box. According to an embodiment of same, the concerned content is located in a primary packaging such as a tube, a box or similar, located in the main box.

Finally, according to another aspect, the invention relates to a method of realisation of an instruction leaflet as previously described. According to this method, some sheets used to carry information are superimposed and interdependent. The method comprises an additional step during which the thinning is carried out. More particularly the thinning is punctured when the instruction leaflet has been made, prior to folding and packing. The related thinning is made by puncture, stamping, pressing, embossing, stamping or similar.

The other characteristics of the invention will result from the following description, with a reference to the appended drawings in which:

DETAILED DESCRIPTION OF THE INVENTION

Figure 1:
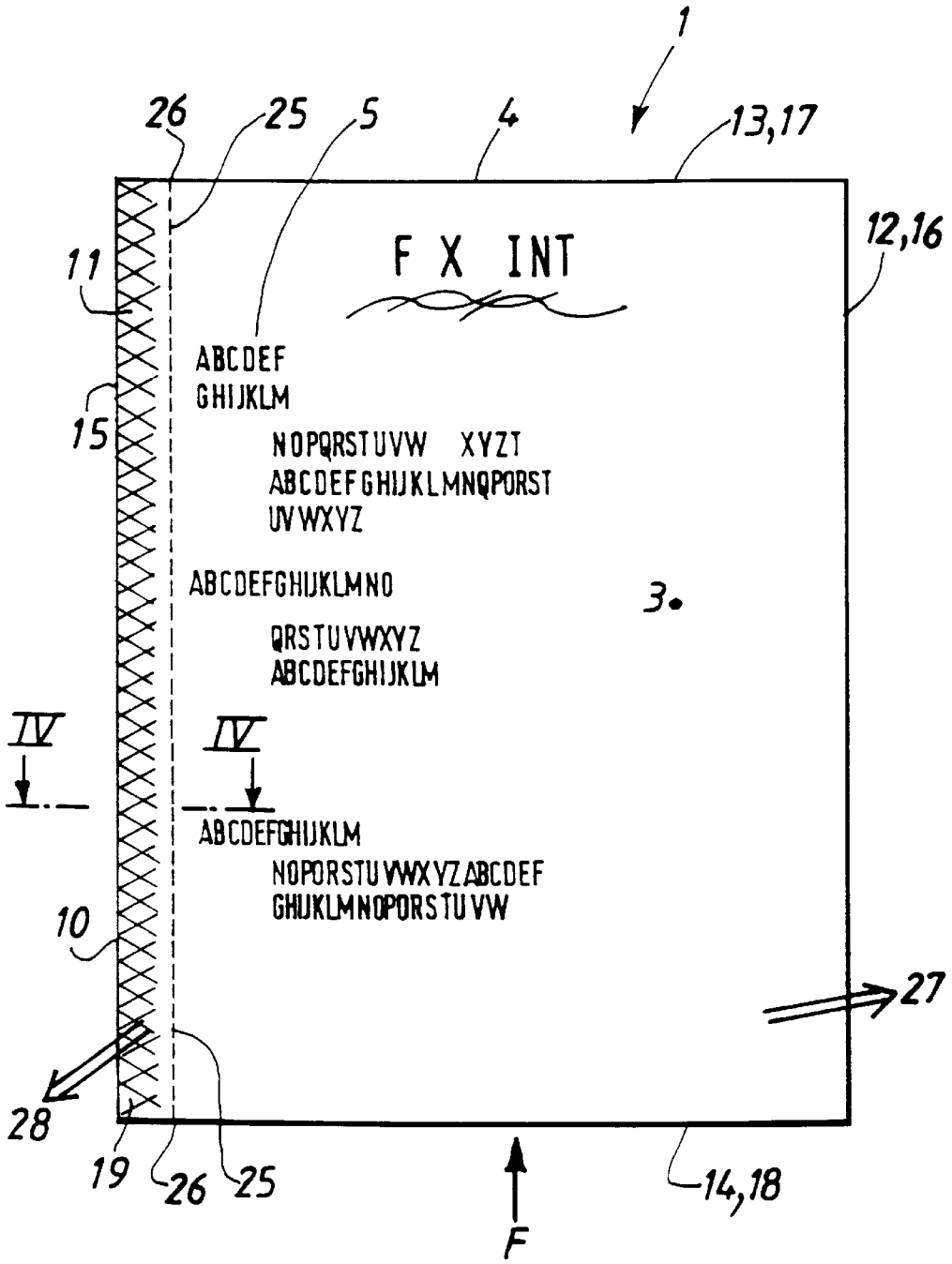
FIG. 1 is a top view of an instruction leaflet according to the invention represented flat.
Figure 2:
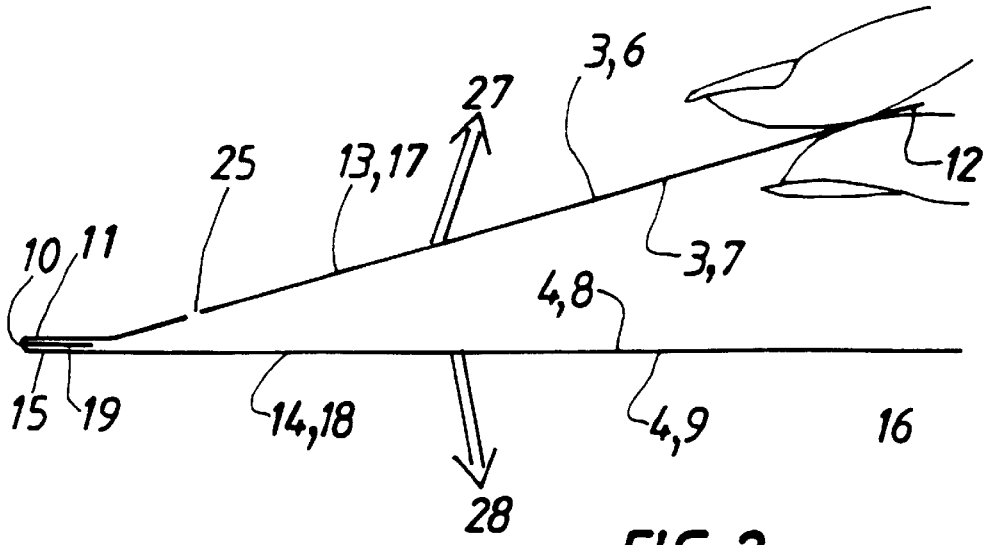
FIG. 2 is a schematic view according to arrow F of FIG. 1 representing a two-sheet instruction leaflet the upper sheet of which is separated from the lower sheet.
Figure 3:
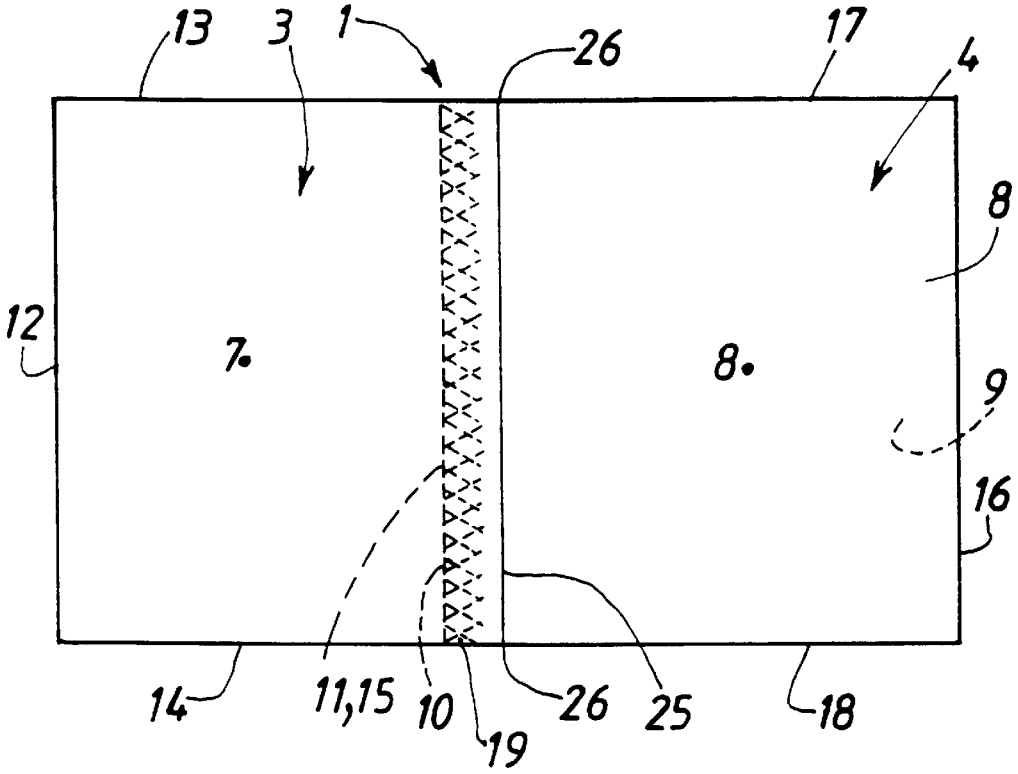
FIG. 3 is a view at a smaller scale of the instruction leaflet of FIG. 1, both sheets of which have been opened.
Figure 4:
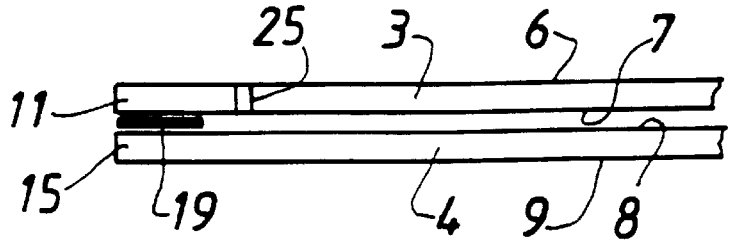
FIG. 4 is a partial sectional schematic view, according to line IV—IV of FIG. 1, showing the instruction leaflet thinning according to the invention.
Figure 5:
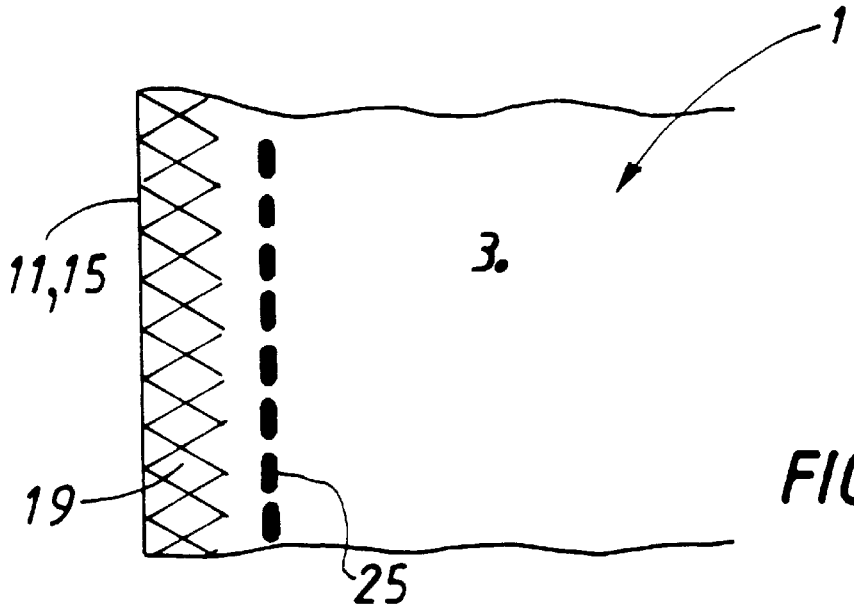
FIG. 5 is a partial top view of the instruction leaflet represented in FIG. 4.

An instruction leaflet 1 according to the invention is made of paper or similar material. Such an instruction leaflet is presented flat (including the case where it is rolled as a coil) or folded, as it is generally the case when it is included in the packaging 2. In the described embodiment, instruction leaflet 1 comprises two sheets 3 and 4. However, in other embodiments, the instruction leaflet can comprise a greater number of sheets. The sheets are thin given their use. Their thickness can decrease to reach the thickness of bible paper.

In the embodiment more especially described here, instruction leaflet 1, and accordingly sheets 3 and 4, have a general rectangular or square shape. For instance, the length of sheets 3, 4 can be 5–20 cm and the width can be 5–15 cm. Sheets 3 and 4 are superimposed and, in the considered embodiment, they have the same shape and dimensions. Both sheets 3, 4 form supports for information 5.

For instance, this printed information is the brand of the considered pharmaceutical product, its identification, composition, pharmaceutical form, class, the operator's name, the cases of utilisation, the directions for use, the mode and way of administration, the undesired effects, the preservation, the revision date of the instruction leaflet, etc. This information 5 can appear on recto 6, verso 7 of sheet 3, on recto 8, verso 9 of sheet 4.

Edge 10 of flat instruction leaflet 1 can be constituted by the common edge of both sheets 3, 4. The edge of sheet 3 is delimited by four sides 11, 12, 13 and 14. Edges 13 and 14 are adjoining edges 11 and 12. Edge 12 is opposite edge 11. Similarly, the edge of sheet 4 is limited by four sides 15, 16, 17 and 18 which coincide with sides 11, 12, 13 and 14 when sheet 4 is superimposed flat on sheet 3.

For instance, sides 11 and 15 are installed vertically and on the left hand side when instruction leaflet 1 is located in a substantially vertical plan to allow reading. Both sheets 3, 4 are rigidly interdependent in the area of association 19 located along and near straight side 11, 15 common to both sheets 3, 4. In the considered embodiment, the area of association 19 is adjacent to sides 11, 15. This area of association 19 extends between sides 13, 14 and 17, 18.

In the direction of sides 13, 14, 17, 18, the area of interdependence is narrow to avoid limiting the surface useful for the information of verso 7 of sheet 3 (considered here as the upper sheet) and recto 8 of sheet 4 (considered as the lower sheet). For instance, in the box of the considered application, the width of the area of association 19 can be a few millimeters approximately. The rigid association of both sheets 3, 4 in area 19 is performed by sticking, welding, stamping, or by any other suitable material, so that both sheets 3, 4 form a unit group and cannot be unexpectedly dissociated in the area of interdependence 19.

As previously mentioned, instruction leaflet 1 can be presented flat or folded when it is included in packaging 2. When it is folded and according to a possible embodiment, instruction leaflet 1 comprises one or more folds 20, extending parallel to sides 11, 15 and area 19.

For instance, according to a typical embodiment, instruction leaflet 1 comprises three folds 20: one median fold 20*a* and two side folds 20*b*. Folds 20 are creased to allow the superposition of the corresponding parts of the instruction leaflet. When it is thus folded, instruction leaflet 1 can still be folded around one or more fold(s) such as 21 perpendicular to the direction of the area of interdependence 19. Contrary to folds 20, fold(s) 21 can be less accentuated or form only a bend.

Figure 20:
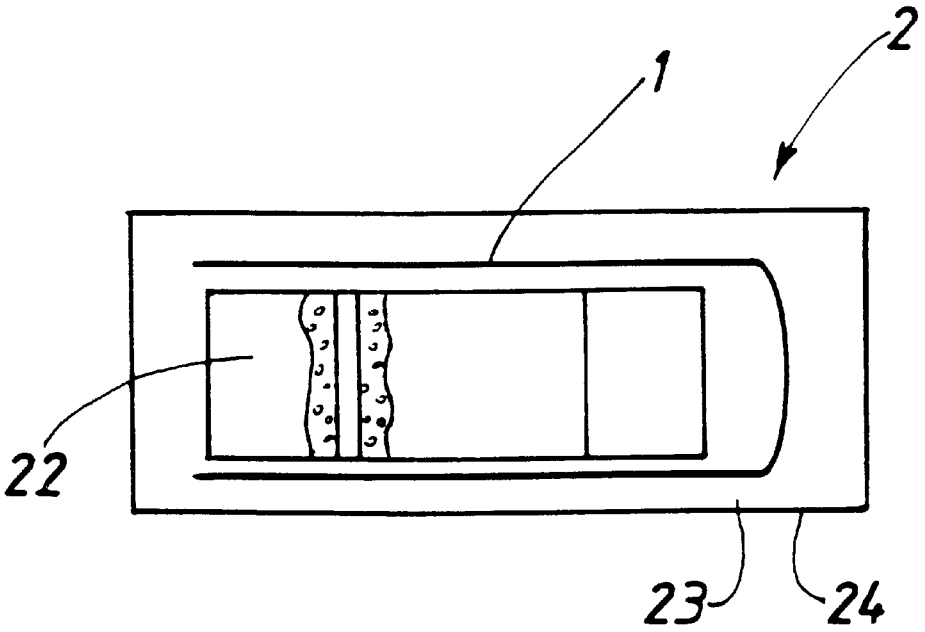

Instruction leaflet 1 is especially suited to a pharmaceutical product 22 (FIG. 20) or similar. "Similar" means that the packed product requires an instruction leaflet to provide information, just as a pharmaceutical product. As the case may be, the pharmaceutical product or similar forming the contents of packaging 2 is introduced into a primary packaging 23 such a tube, a box or similar, this primary packaging 23 being itself introduced into a principal box 24.

Instruction leaflet 1 also comprises at least one thinning 25 extending longitudinally, on at least one of sheets 3, 4. This thinning 25 can allow a manual tearing by a suitable external action. Thinning 25 crosses the edge of the corresponding sheet on both extremities 26 and allows the division of the originally single instruction leaflet into at least two distinct parts 27, 28.

Figure 8:
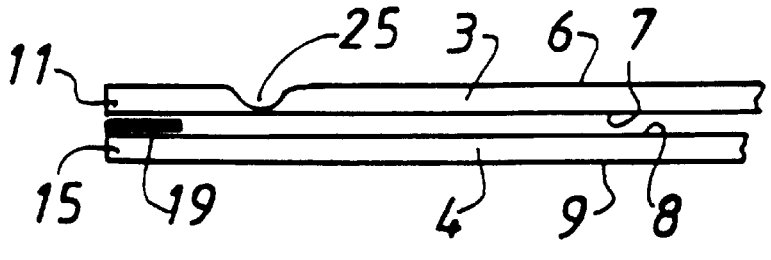
Figure 9:
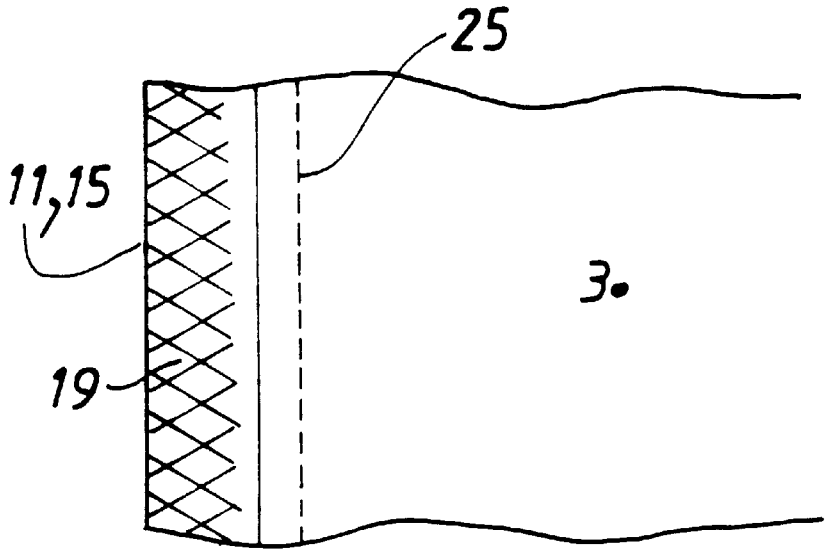
FIGS. 9 and 10 are two top views similar to FIG. 5 corresponding to other embodiments.
Figure 10:
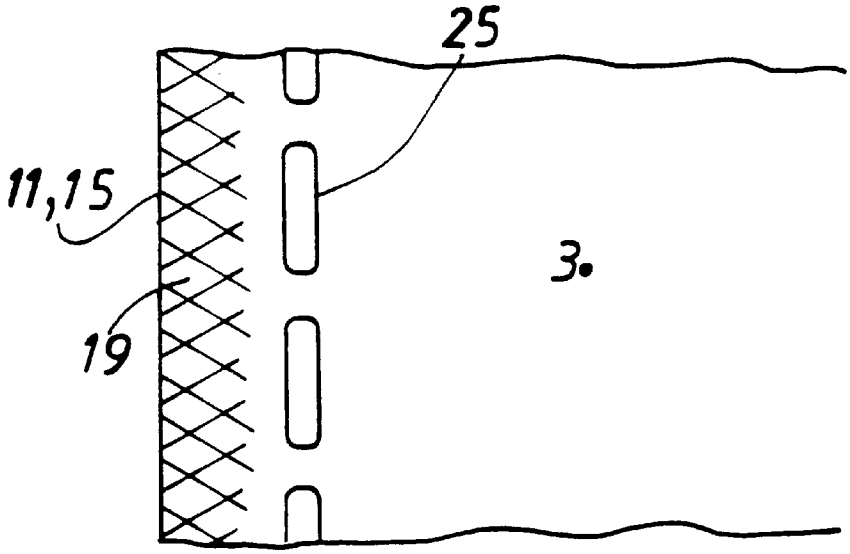

Thinning 25 is formed either as a succession of spaced punctures, with or without material removal (FIGS. 1 to 7 and 12), or as a continuous (FIGS. 8 and 9) or discontinuous (FIG. 10) localised thinning. Such a thinning is made by puncturing, punching, pressing, embossing, stamping or similar. The thinning is done after the instruction leaflet is completely finished but prior to any folding and packaging.

As regards the making of the instruction leaflet itself, it comprises the steps of superposition and interdependence of sheets 3, 4 which form the information base. Accordingly, the invention also relates to a method of making an instruction leaflet as previously described, which comprises an additional step of thinning.

Figure 11:
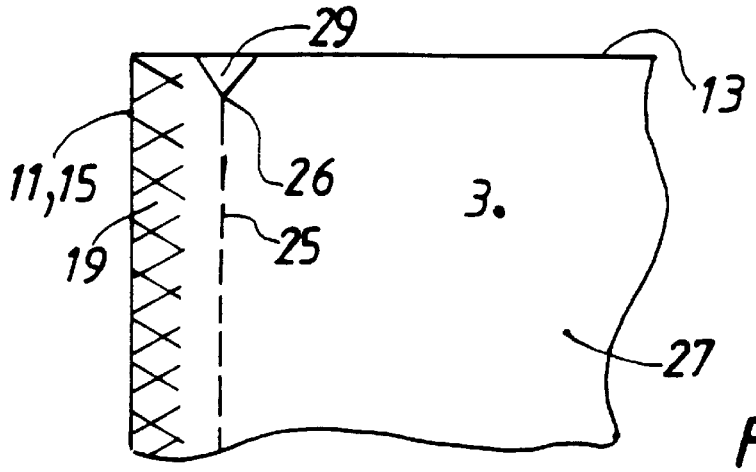
FIG. 11 is a schematic top view, showing an embodiment with a tearing leader.

Reference is more particularly made to FIG. 11 which shows the presence of a tearing leader 29 of thinning 25 on a side such as 13, 14 located on one of extremities 26. Here, this leader 29 is a V-shape notch. In the embodiment of FIGS. 1 to 11, thinning 25 is totally located near, along and close to the area of interdependence 19.

Figure 12:
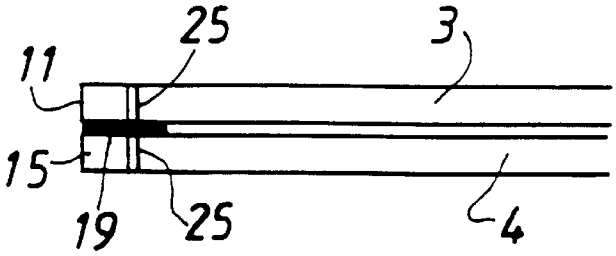
FIG. 12 is a schematic view similar to FIG. 4 corresponding to a special embodiment where the thinning is located in the area of interdependence.
Figure 13:
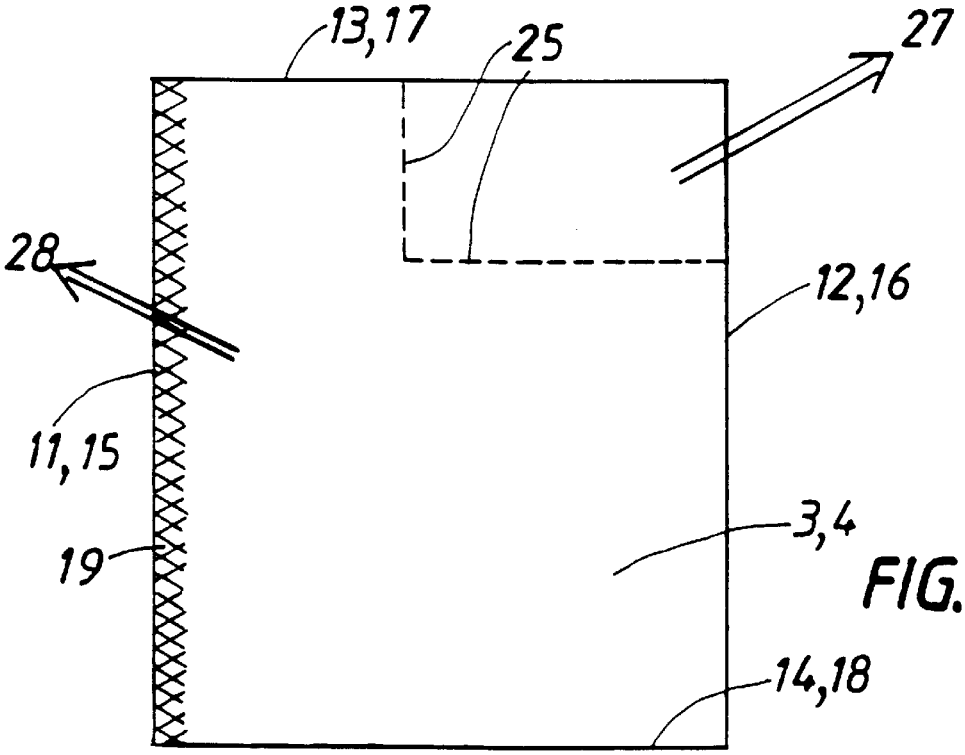
FIGS. 13, 14, 15 and 16 are four schematic top views corresponding to FIG. 1 of four variants of execution.
Figure 15:
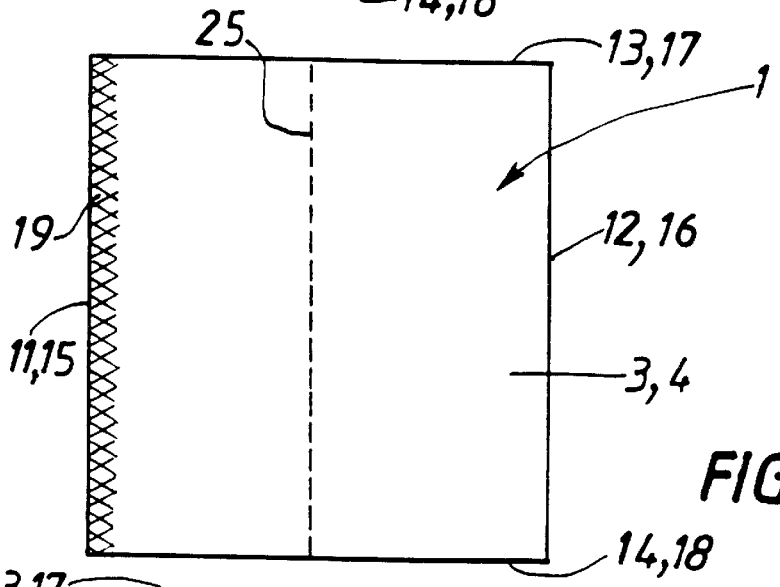
Figure 16:
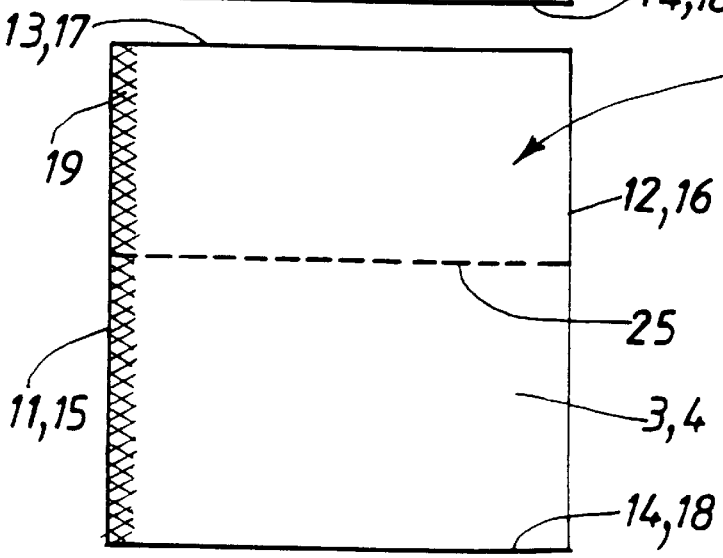

In the case of FIGS. 13 and 15, the thinning 25 is at least partly located near, along or more distant from the area of interdependence 19. In the embodiment of FIG. 12, the thinning 25 is located in the area of interdependence 19. In the case of the embodiments of FIGS. 4 and 8, only one of the sheets—sheet 3—is fitted with a thinning 25. In the case of the embodiment of FIG. 12, each sheet 3, 4 is fitted with a thinning 25. Both thinning are superposed together.

Figure 6:
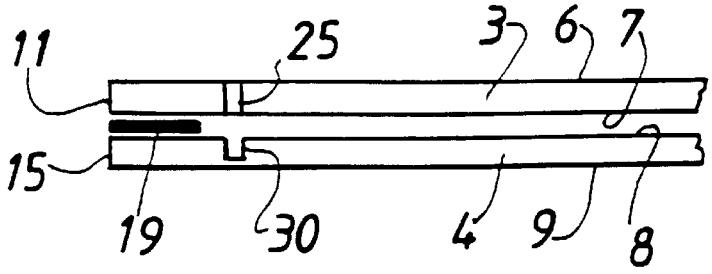
FIGS. 6, 7 and 8 are three schematic views similar to FIG. 4 corresponding to other embodiments.
Figure 7:
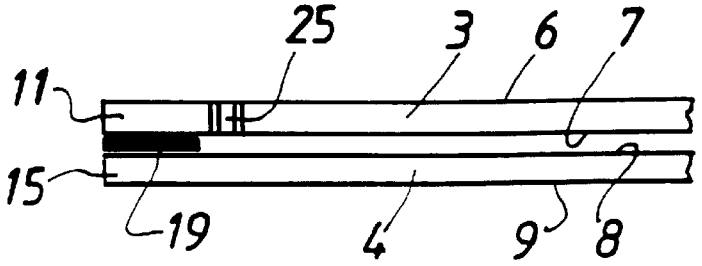

In the case of FIG. 6, one of the sheets—sheet 3—is fitted with a thinning 25 while the other sheet—sheet 4—comprises a modification 30 resulting from the making of the thinning 25, perpendicular to thinning 25. This modification 30 is not normally intended for manual tearing of division as for thinning 25.

In the case of FIGS. 1, 15, 16, 17, the thinning 25 extends longitudinally along a straight line with a single segment. In the case of the embodiment of FIGS. 13 and 14, the thinning 25 extends along a straight line with two segments, perpendicular to one another. In the case of FIG. 6, the thinning 25 has the general shape of a single thinning line; in the case of FIGS. 8 and 9, it is a continuous thinning area, and in the case of FIG. 10 there are several juxtaposed areas.

Figure 14:
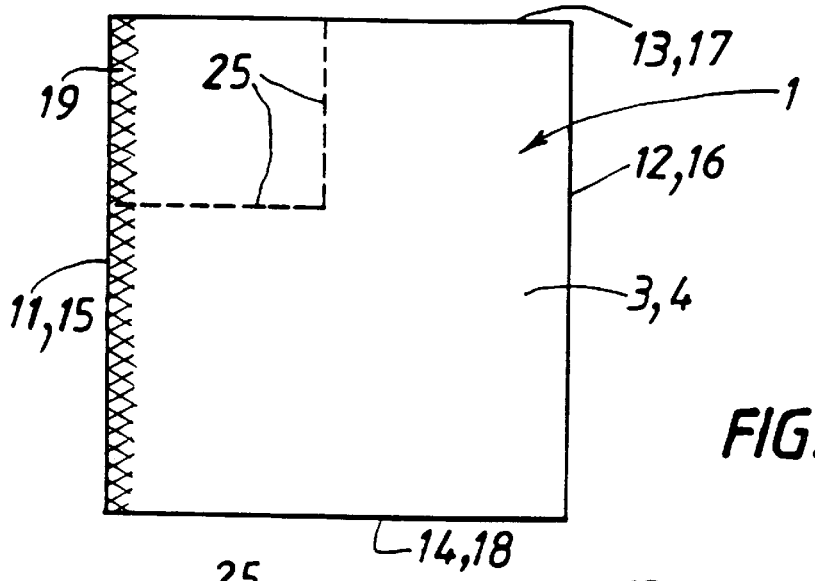

In general, at least at one of both extremities 26, thinning 25 crosses at least one of sides 13, 14 adjacent to the one along which the area of interdependence 19 extends. In the case of the embodiment of FIG. 1, the thinning 25 crosses both sides 13, 14 adjoining side 11 where the area of interdependence 19 is located, at its two extremities 26. In the case of FIGS. 13 and 14, the thinning 25 crosses side 13 on the one hand and on the other hand, either side 12 (FIG. 13) or side 11 (FIG. 14). In the case of FIGS. 1, 13 and 15, the thinning 25 does not cross the area of interdependence 19. On the contrary, the thinning 25 crosses this area 19 in the case of FIGS. 14 and 16.

Figure 17:
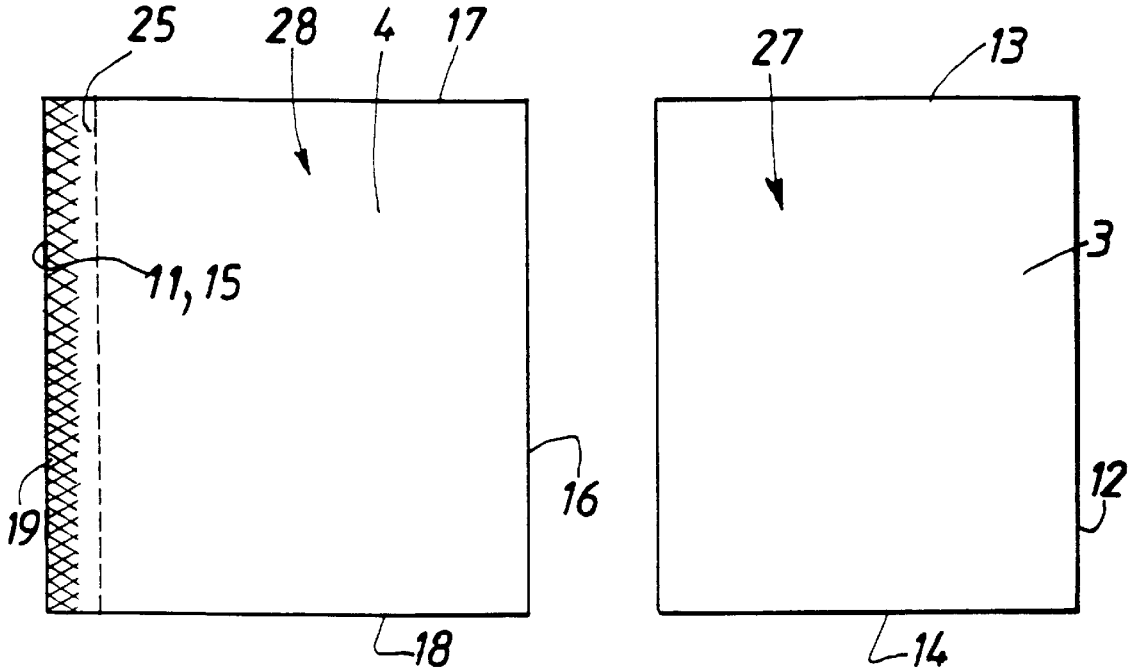
FIG. 17 is a top view, at a smaller scale, corresponding to FIG. 1, showing the instruction leaflet divided into two parts.
Figure 18:
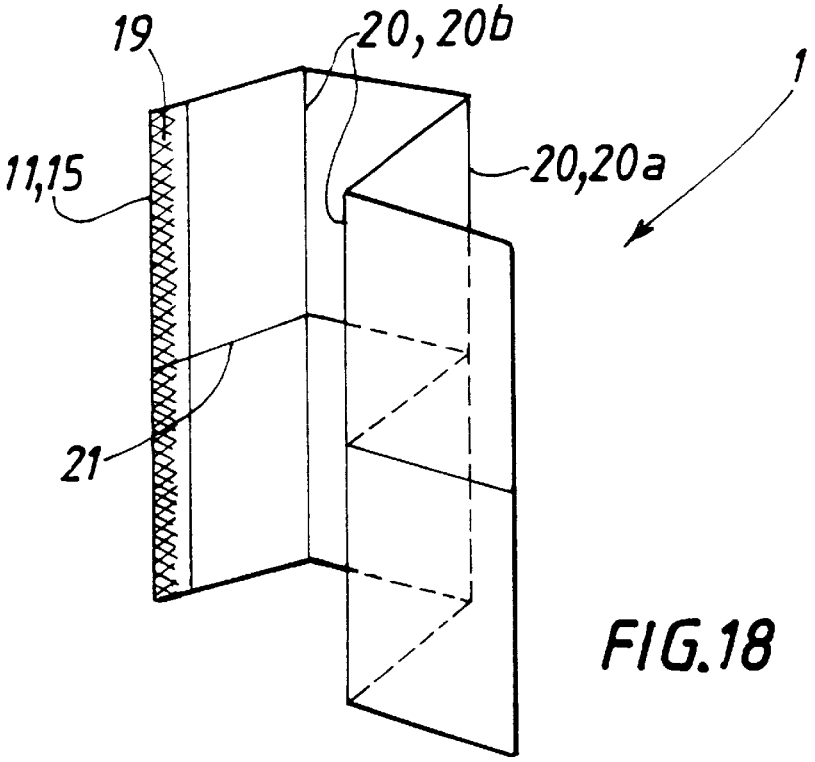
FIGS. 18 and 19 are two schematic views in perspective showing the folding of the instruction leaflet; and, FIG. 20 is a sectional view through a transverse plan showing packaging including the folded instruction leaflet.

FIG. 1 corresponds to the case where thinning 25 is located so that at least one of parts 27 resulting from the tearing in the place where thinning 25 substantially corresponds to one of sheets 3, except essentially the area of interdependence 19 which belongs to the other part 28 as it can be seen in FIG. 17. A double arrow indicates the separation of the instruction leaflet to obtain parts 27 and 28.

In this case, and if thinning 25 relates to both sheets 3 and 4, the instruction leaflet can be divided into three parts, a first part substantially corresponding to sheet 3 except for the area of interdependence, a second part substantially corresponding to the other sheet 4 except for the area of interdependence and finally, a small part corresponding to the area of interdependence and to both sections adjoining the area of interdependence 19 of both sheets 3 and 4.

An instruction leaflet as described above is particularly well suited when one sheet has to be detached from the originally single instruction leaflet.

In the case of FIG. 1, the instruction leaflet comprises just one area of association 19 and a thinning 25 close to area 19.

Figure 17A:
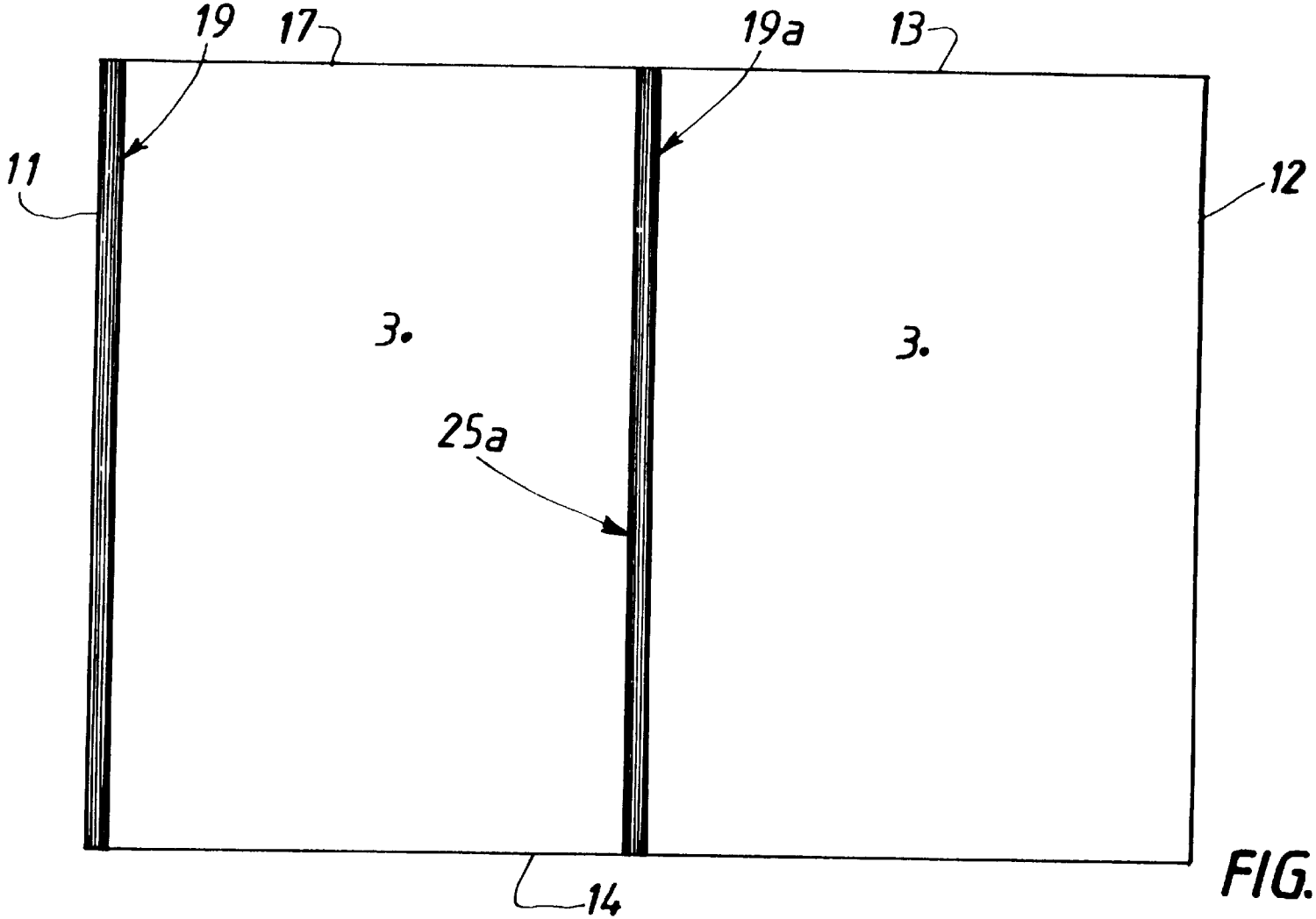
FIG. 17*a* is a top view of an instruction leaflet according to another embodiment, represented flat.
Figure 19:
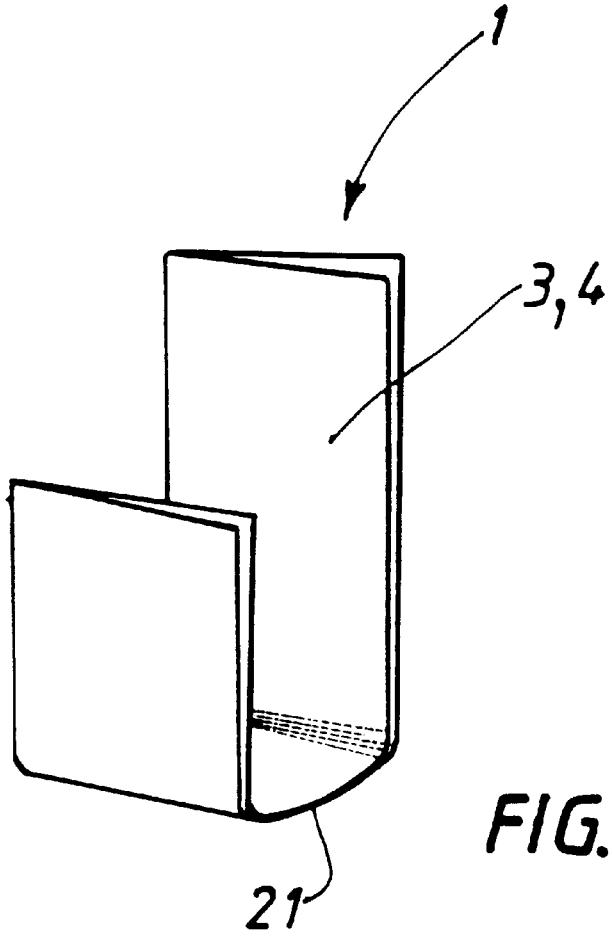

In the case of FIG. 17*a*, on each sheet 3, 4, the instruction leaflet has a second area of association 19*a* parallel to the first area of association 19, and, for example, substantially in the middle of sheets 3 and 4. Sheets 3, 4 are rigidly associated at the level of both areas of association 19, 19*a*. Only sheet 3 has been shown in FIG. 17*a*.

In this case, sheets 3, 4 have no thinning 25 close to the first area 19 but a thinning 25*a* near the second area 19*a*, on the side of the second area 19*a* which is turned to the first area 19. The tearing according to thinning 25*a* of both sheets of the double instruction leaflet results in the division of the instruction leaflet into two double instruction leaflets which no longer comprise thinning 25.

What is claimed is:

1. An instruction leaflet for pharmaceutical packaging comprising at least two substantially similar superposed sheets having a book basis weight of less than thirty pounds, said at least two sheets carrying printed information thereon and rigidly joined in an area of interdependence along and close to a common straight side of edges of each of said at least two sheets, said leaflet adapted to be folded parallel and/or perpendicular to a direction of said area of interdependence, on at least one of said at least two sheets, at least one thinning longitudinally extends so as to allow a manual tearing therealong, said thinning traversing a longitudinal extent of said sheet and thus enabling division into at least two distinct parts.

2. The instruction leaflet of claim 1 wherein said thinning comprises a succession of spaced perforations.

3. The instruction leaflet of claim 1 wherein said thinning has opposing ends and is fitted with a tearing leader at least at one of said ends.

4. The instruction leaflet of claim 1 wherein said thinning is at least partly located adjacent said area of interdependence.

5. The instruction leaflet of claim 1 wherein said thinning is at least partly located along and in an area of localisation.

6. The instruction leaflet of claim 1 wherein only one of said at least two sheets is fitted with said thinning.

7. The instruction leaflet of claim 1 wherein all of said at least two sheets of said instruction leaflet are fitted with said thinning.

8. The instruction leaflet of claim 7 wherein said thinning of each of said at least two sheets are superposed.

9. The instruction leaflet of claim 1 wherein one or more of said at least two sheets are fitted with said thinning while one or more other of said at least two sheets include a modification resulting from said thinning, said modification being perpendicular to said thinning.

10. The instruction leaflet of claim 1 wherein said thinning sequentially extends along a straight line so as to form thinning segments.

11. The instruction leaflet of claim 1 wherein said thinning comprises several juxtaposed lines.

12. The instruction leaflet of claim 1 wherein at least one of said ends of said thinning crosses at least one of said at least two sheets adjoining another side of said at least two sheets adjacent said area of interdependence.

13. The instruction leaflet of claim 12 wherein said ends of said thinning (25) cross both sides of said at least two sheets adjoining another side of said at least two sheets adjacent said area of interdependence.

14. The instruction leaflet of claim 1 wherein said thinning does not cross said area of interdependence.

15. The instruction leaflet of claim 1 wherein said thinning crosses said area of interdependence.

16. The instruction leaflet of claim 1 wherein said thinning is located so that at least one distinct part resulting from tearing at said thinning substantially corresponds to one of said sheets, except for said area of interdependence which remains integral with said sheet.

17. The instruction leaflet of claim 1 wherein said leaflet has a rectangular configuration.

18. The instruction leaflet of claim 1 wherein at least some of said at least two sheets have substantially the same shape and dimensions.

19. The instruction leaflet of claim 1 wherein said sheets are folded parallel and/or perpendicular to said direction of said area of interdependence and on a side adjoining said edge.

20. Packaging comprising a principal box, an instruction leaflet according to claim 1 being included therein.

21. An assembly comprising a packaging according to claim 20 and a content located in said principal box.

22. An assembly according to claim 21 in which said content is contained in a primary packaging which is introduced in said main box.

23. In a method of making an instruction leaflet according to claim 1 wherein said sheets are superposed and joined, the step of thinning.

24. A method according to claim 23 wherein the thinning produced is located on the formed instruction leaflet prior to subsequent steps of folding and packaging.

25. A method according to claim 23 wherein said thinning is produced by an operation selected from the group consisting of puncturing, punching, pressing, embossing, or stamping.

* * * * *